US006848671B2

(12) United States Patent
Hegemier et al.

(10) Patent No.: US 6,848,671 B2
(45) Date of Patent: Feb. 1, 2005

(54) VALVE SPRING ANTI-ROTATION APPARATUS

(75) Inventors: Timothy A. Hegemier, Avilla, IN (US); Steven M. Fisher, Ft. Wayne, IN (US)

(73) Assignee: Dana Corporation, Toledo, OH (US)

( * ) Notice: Subject to any disclaimer, the term of this patent is extended or adjusted under 35 U.S.C. 154(b) by 90 days.

(21) Appl. No.: 09/997,861

(22) Filed: Nov. 29, 2001

(65) Prior Publication Data

US 2003/0098432 A1 May 29, 2003

(51) Int. Cl.[7] ..... F16K 41/00
(52) U.S. Cl. ..... 251/214; 251/337; 123/188.6
(58) Field of Search ..... 251/214, 330, 251/337; 123/188.6, 188.2, 188.17, 90.65, 90.67; 277/313, 502

(56) References Cited

U.S. PATENT DOCUMENTS 1,586,613 A * 6/1926 Disch ..... 123/188.6 X
2,613,656 A 10/1952 Leach
2,868,188 A 1/1959 Havens
2,935,979 A 5/1960 Havens
3,577,972 A * 5/1971 Moray ..... 123/188.6
3,659,491 A 5/1972 Duffy et al.
3,945,607 A 3/1976 Dashner
4,325,558 A * 4/1982 Poggio ..... 277/502
4,470,383 A * 9/1984 DeBolt ..... 123/90.65
4,811,703 A 3/1989 Rericha et al.
4,834,037 A * 5/1989 Lafever ..... 123/188.6
5,044,330 A 9/1991 Havens et al.
5,052,658 A 10/1991 Heil
5,071,140 A 12/1991 Quevedo del Rio
5,170,991 A 12/1992 Heil
5,263,444 A 11/1993 Prior et al.
5,299,843 A 4/1994 Weigl et al.
5,553,869 A 9/1996 Stamback
5,681,136 A 10/1997 Blair
5,775,284 A * 7/1998 Kirchner et al. ..... 123/188.6
5,785,322 A 7/1998 Suggs et al.
5,954,343 A 9/1999 Sumida et al.
6,119,645 A 9/2000 Hesher ..... 123/188.6
6,148,783 A 11/2000 Hesher et al.
6,202,983 B1 3/2001 Hartman et al.

* cited by examiner

*Primary Examiner*—Eric Keasel
(74) *Attorney, Agent, or Firm*—Rader, Fishman & Grauer PLLC

(57) ABSTRACT

A valve stem seal assembly includes several protrusions or bumps on the bottom of a spring seat flange or on a spring wear washer surrounding the seal. The protrusions can be either cast formed or machined in place. In described embodiments, the protrusions are adapted to engage corresponding depressions, holes, or receptors in a cylinder head deck surface against which the flange or wear washer abuts. A positive mechanical anchor is thereby created for resisting any torque applied to the flange or washer through mechanical vibration induced rotation of the valve spring. Sliding contact is thereby avoided at the interface between the flange or washer and the cylinder head, and wear is prevented. Use of one disclosed embodiment will require that the cylinder head manufacturer provides a cylinder head that includes several small depressions or apertures in the valve spring seat area that correspond with the disclosed protrusions or bumps.

12 Claims, 2 Drawing Sheets

VALVE SPRING ANTI-ROTATION APPARATUS

BACKGROUND OF THE INVENTION

1. Field of Invention

The present invention relates to valve spring and valve stem seal assemblies for use in internal combustion engines, and more particularly to bottom flange portions of such assemblies adapted to bear against cylinder head decks.

2. Description of the Prior Art

Those skilled in the art will appreciate the manner in which intake and exhaust valves are employed in cylinder heads of internal combustion engines. Such valves include integral elongated stems extending away from the engine cylinder heads, the ends of the stems interacting with rotating cams for cyclic repeated opening and closure of the valves during the combustion cycle.

The valve stems thus move reciprocally to and from the cylinder head, and so-called valve stem seal assemblies, also variously called valve seal assemblies, are used to seal against leakage of oil through a clearance path between each annular engine valve guide and an associated valve stem supported for reciprocal motion within that particular guide. Obviously, in order to permit unobstructed reciprocal movement of the stem in the guide, some mechanical clearance must exist between the valve guide and the moving stem.

Thus as is well known, the intake ports of a combustion chamber are opened and closed by the reciprocating motion of at least one intake valve, which in turn is driven by the rotary motion of a cam, the latter being affixed to and rotary with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of the same construction, and include stems integrally affixed to the valves.

In the typical engine, a valve seal assembly is fitted over each valve stem, each assembly being frictionally mounted over an associated valve guide to assure its securement within the engine. The valve guide normally extends upwardly from a cylinder head deck of the engine. Typically each valve seal assembly has two primary parts; 1) an elastomeric valve seal positioned at its upper end to control leakage of oil between the valve stem and guide as noted, and 2) a structural cylindrical part called a retainer which is mounted atop of, and is axially secured to, the valve guide.

In some cases, the retainer has a so-called bottom flange that extends radially over and against the valve spring seat of the cylinder head deck. As those skilled in the art will appreciate, the cylinder head deck provides support for the bottom flange, or so-called spring seat flange, against which valve return springs bear. One recurring issue has been that the bottom of the spring seat flange tends to rotate under conditions of vibration, producing undesirable wear between the cylinder head deck and the flange.

In some limited cases, particularly relating to exhaust valves, no valve stem seal assembly is included. Under the latter arrangement, only a guide and stem is employed, and the valve return spring typically bears against a washer instead of a seal retainer flange. In such cases, the washer gives rise to the same problem.

Several techniques and structures for preventing rotation of valve stem seal parts that bear against a valve spring and/or a cylinder head deck have been proffered, including tabs designed to avoid rotation of valve stem seal parts for avoidance of wear. However, there has not yet been a fully satisfactory solution to the issue presented.

SUMMARY OF THE INVENTION

This invention offers an improved anti-rotation system for a valve stem spring seat flange or washer subject to torque loads particularly induced by engine vibrations. Several protuberances or surface projections are arranged on the bottom of a spring seat flange or wear washer of the valve stem seal assembly. In at least one described embodiment, protuberances or bumps are adapted to engage corresponding depressions, holes, or receptors in a valve spring seat area of a cylinder head surface against which the flange or wear washer abuts. The purpose of the invention is to provide a positive, mechanical anchor for resisting torque applied to the spring seat flange or washer via rotation of the valve spring induced by mechanical engine vibrations.

The protuberances prevent sliding contact between the valve spring flange or washer and cylinder head at the interface between the seal or washer and the cylinder head. Premature part wear is thus avoided. In at least one embodiment of the invention as disclosed, a cylinder head manufacturer will be required to produce a cylinder head with several small depressions or apertures in the valve spring flange or wear washer area to correspond with the inventive protrusions or bumps on the flange or washer. It is contemplated that the protrusions or bump structures may be either cast formed or machined in place.

DETAILED DESCRIPTION OF THE PREFERRED EMBODIMENTS

Figure 1:
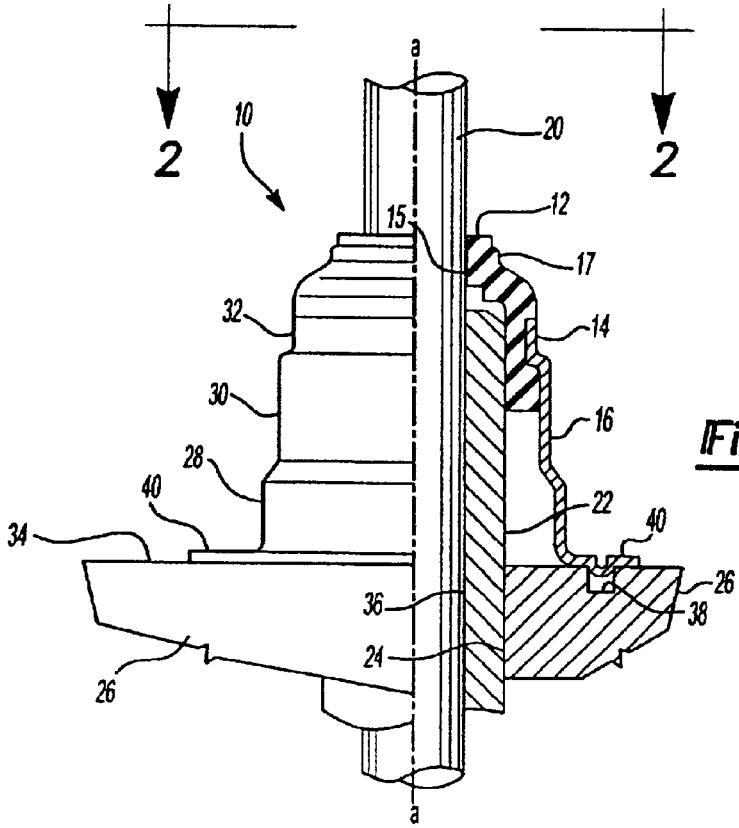
FIG. 1 is an elevation view of one preferred embodiment of a valve stem seal assembly of the present invention, wherein the seal assembly is shown installed atop a valve guide extending upwardly from a cylinder head deck, the seal assembly engaging a valve stem, and wherein a partial cut-away reveals a view in cross-section of an elastomeric seal and metallic retainer incorporated in the preferred embodiment.

Referring initially to FIG. 1, a valve stem seal assembly 10 incorporates an elastomeric seal body 12 supported via an upper end portion 14 of a cylindrical metallic retainer 16. The seal body 12 is a generally annular member that includes interior and exterior surfaces 15 and 17, respectively. The seal body 12 is circumferentially supported in the retainer end portion 14 by its exterior surface 17, as revealed in the cut-away portion of FIG. 1. The interior surface 15 of the seal 12 is a circumferentially extending valve stem sealing media adapted to engage a reciprocally movable valve stem 20. Those skilled in the art will appreciate that the valve stem 20 contains a valve member, such as a valve head (not shown). In some cases, the seal body 12 also incorporates a valve guide seal lip adapted to engage the top of a valve guide, although not the case in this particular embodiment.

Figure 2:
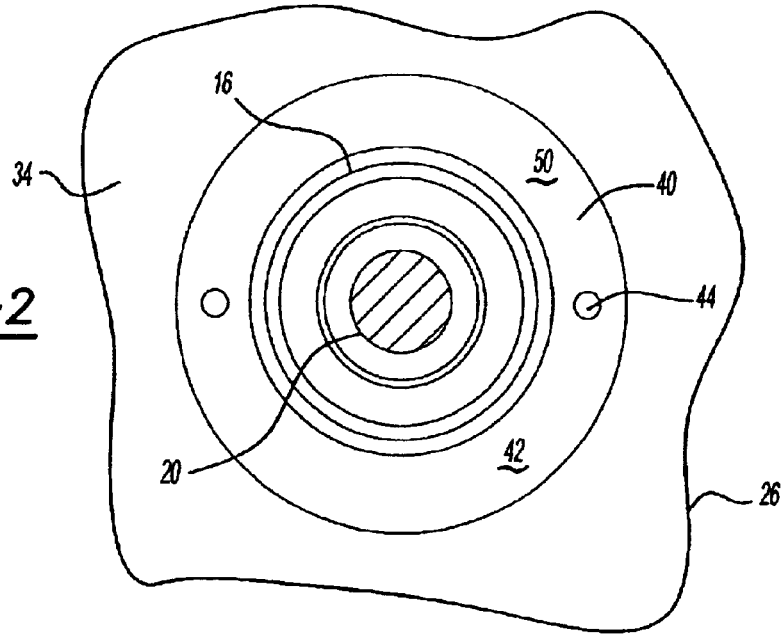
FIG. 2 is plan view of the valve stem seal assembly structure of FIG. 1.

Referring now also to FIG. 2, the described valve stem seal assembly 10 is shown installed over a valve guide 22 that is press fit or welded to a guide aperture 24 of a cylinder head deck 26 of an engine (not shown). Those skilled in the art will appreciate that the valve guide 22 protrudes axially upwardly from the deck 26, and supports the valve stem 20 for reciprocal movement therein. As depicted, the seal assembly is installed over, and is thus frictionally secured to, the annular valve guide 22, which in turn is frictionally secured within the noted aperture 24 that extends through the cylinder head deck 26. It will be apparent that the valve stem seal assembly 10 is only installed over that portion of the valve guide that protrudes above the cylinder head deck 26, and that the valve stem 20 is designed to reciprocate within a stem-receiving aperture 36 defined by the interior of the valve guide 22.

During the operation of an engine (not shown), the combustion process occurs in rapid cyclic fashion. The valve (not shown) affixed to the valve stem 20 is designed to open and close an intake (or exhaust) valve port (not shown) at a rate of several times per second. A cam on a camshaft (neither shown) urges a cam actuated opposite end (not shown) of the valve stem 20 downwardly in a reciprocal or cyclic manner against the constant force of a valve return spring (not shown) that bears directly against a retainer flange or spring seat flange 40. In accordance with FIGS. 1 and 2, it will be appreciated that the return spring bears against the upper surface 50 of the flange 40. The flange 40 defines the lowest extremity of the retainer 16, and is formed at the largest diameter section 28 of the retainer. The retainer has upwardly converging, successively smaller diameter sections 30 and 32, as referenced from the deck 26. Section 32 is part of the upper end 14 that supports the seal body 12.

To the extent that the combustion process occurs within a cylinder (not shown) positioned just under the cylinder head deck 26, the valve assembly 10 is positioned extremely close to the combustion process. As such, the valve assembly 10 and associated valve return spring that bears against the flange 40 are subject to considerable vibrations. It has been determined that this vibration gives rise to a tendency of the spring that bears against the flange 40 to rotate under vibration induced torque forces. Since the deck 26 is normally formed of a relatively soft cast-iron or aluminum, the hardened steel of the retainer flange 40 has a tendency to scour and to otherwise damage the surface 34 of the cylinder head deck 26.

This invention therefore provides several embodiments of the flange 40 that are adapted to counteract a tendency of the flange 40 to rotate and to undergo sliding contact at the interface between the flange and the deck surface 34. Instead, the sliding contact will be transferred to the interface between the valve spring and the flange 40. The latter approach provides a significant advantage because both the spring and the flange are typically made of hardened steel, and are more suitable for handling relative rotation of parts under the typically significant loads imposed by valve return springs.

Figure 3:
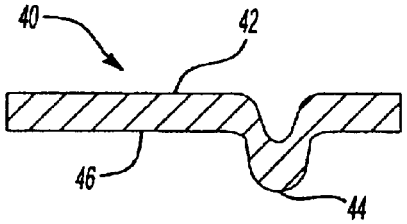
FIG. 3 is a fragmentary cross-sectional view of one preferred embodiment of a spring seat flange on the retainer of FIGS. 1 and 2.

Referring now to FIG. 3, a fragmentary cross-sectional portion of a first embodiment of the improved flange 40 incorporates a radially extending body 42 having a bottom surface 46 that includes an axially protruding projection or bump 44. A plurality of such bumps 44 are employed, and adapted to engage corresponding depressions, holes, or receptors, shown as a depression 38 (FIG. 1), provided in the top surface 34 of the cylinder head deck 26. A stamping process may be employed to form the bumps 44 during manufacture of the metallic retainer 16.

Figure 4:
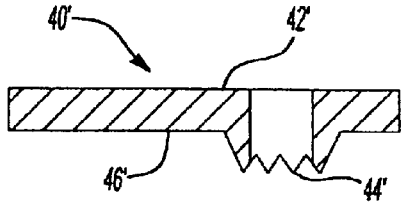
FIG. 4 is a similar cross-sectional view of another preferred embodiment of the spring seat flange.

Another embodiment of an improved flange 40' is depicted in FIG. 4. This embodiment does not require a corresponding depressions, hole, or receptor to be provided in the top surface 34 of the cylinder head deck 26. Instead, this embodiment provides a sharp protuberance on the bottom of the flange 40' that is adapted to bite into the deck surface 34 to prevent rotation of the flange 40'. The flange 40' has the form of a "multiple star" pattern, essentially a circular jagged edge, that can be produced simply by a through-hole punching process applied to the radially extending top surface 42'. Such a process will assure that the jagged edge extends from the bottom surface 46' of the flange 40' as intended.

Figure 5A:
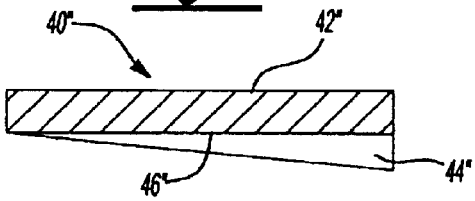
FIGS. 5A and 5B are cross-sectional side and end views of yet another preferred embodiment of the spring seat flange.
Figure 5B:
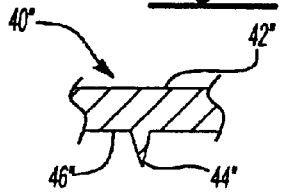

A third embodiment of the flange 40" is depicted in FIGS. 5A and 5B. The flange 40" includes a protuberance 44" in its bottom surface 46" that may be described as a "sharp radial ridge" pattern. The protuberance 44" extends radially outwardly along the bottom surface 46" of the flange 40". Similar to the previously described embodiment of the protuberance 44', the protuberance 44" is adapted to bite into the surface 34 of the cylinder head deck 26.

Figure 6:
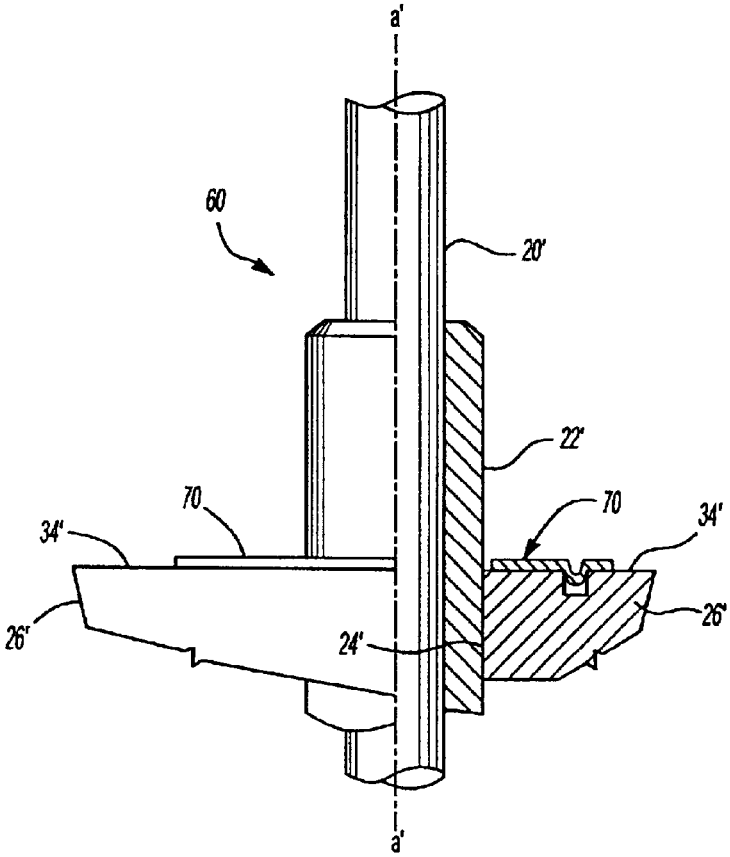
FIG. 6 is a preferred embodiment of a spring seat washer employed with a simple guide and stem arrangement that does not include a valve stem seal assembly.

Finally, a fourth embodiment of the present invention is shown in FIG. 6. A washer 70 has a bump style protuberance similar to that of the first described embodiment. As depicted, the washer 70 is employed in a valve guide and stem assembly 60 having no valve stem seal, such as might be employed for an exhaust valve application, as earlier noted. The washer 70 is supported on the deck 34' and circumferentially surrounds the valve guide 22. To the extent that the washer 70 is a stand-alone item and is not part of a valve stem seal retainer, it is dissimilar in that respect from the previously described embodiments. All other aspects of the described invention apply to the washer 70 of the embodiment 60. Thus, the washer 70 can be modified to include the prior described alternate forms of protuberances 44' and 44".

Although the described embodiments of this invention contemplate that the retainer is formed of metal, other materials may be suitable depending upon the harshness of the particular environment. For example, some glass-filled nylons or other plastics may be suitable for some engine environments, particularly the first described bump style protuberance 44. In such cases the cylinder head deck will include depressions or apertures to accommodate protuberances 44 formed of plastic materials. Moreover, the spring loads against the flange 40 would necessarily be relatively low for successful application.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A valve stem seal assembly comprising an elastomeric seal body and a cylindrical retainer defining a longitudinal axis, said retainer comprising an upper end portion that circumferentially supports said seal body; said elastomeric seal body comprising an annular valve stem seal adapted for sealingly engaging a reciprocally movable valve stem; said cylindrical retainer further comprising a lower extremity defining a radially outwardly extending spring seat flange having an uninterrupted outer periphery defined between an upper surface and a bottom surface, said bottom surface adapted to bear against a cylinder head deck, wherein said bottom surface comprises at least one protrusion spaced radially inwardly from said outer periphery and extending axially downwardly therefrom, said protrusion adapted for engagement with the cylinder head deck.

2. The valve stem seal of claim 1 wherein said protrusion on said bottom surface of said spring seat flange that engages said depression is adapted to resist torque forces applied to said spring seat flange by mechanical vibrations.

3. The valve stem seal of claim 1 wherein said entire flange is unbroken between said upper surface and the lowermost axial extent of said protrusion.

4. The valve stem seal of claim 1 wherein said protrusion is adapted for engagement with at least one depression in the cylinder head deck that corresponds to said protrusion.

5. The valve stem seal of claim 4 wherein said protrusion includes at least one sharp edge and is adapted to bite into the surface of the cylinder head deck at a position that corresponds to said protrusion to thereby create said depression.

6. The valve stem seal of claim 5, wherein said protrusion also extends radially along said bottom surface and adapted to bite into the surface of the cylinder head deck along a radial area thereof that corresponds to said protrusion.

7. A valve stem seal assembly comprising an elastomeric seal body and a cylindrical retainer defining a longitudinal axis, said retainer comprising an upper end portion that circumferentially supports said seal body; said elastomeric seal body comprising an annular valve stem seal adapted for sealingly engaging a reciprocally movable valve stem; said cylindrical retainer further comprising a lower extremity defining a radially outwardly extending spring seat flange having an uninterrupted outer periphery defined between an upper surface and a bottom surface, said bottom surface adapted to bear against a cylinder head deck, wherein said bottom surface comprises at least one sharp edged protrusion spaced radially inwardly from said outer periphery and extending axially downwardly therefrom, said protrusion adapted to bite into the surface of the cylinder head deck at a position that corresponds to said protrusion.

8. The valve stem seal of claim 7 wherein said sharp edged protrusion on said bottom surface of said spring seat flange that engages the cylinder head deck is adapted to resist torque forces applied to said spring seat flange by mechanical vibrations.

9. The valve stem seal assembly of claim 7 wherein said entire flange is unbroken between said upper surface and the lowermost axial extent of said protrusion.

10. A valve stem seal assembly comprising an elastomeric seal body and a cylindrical retainer defining a longitudinal axis; said retainer comprising an upper end portion that circumferentially supports said seal body; said elastomeric seal body comprising an annular valve stem seal adapted for sealingly engaging a reciprocally movable valve stem; said cylindrical retainer further comprising a lower extremity defining a radially outwardly extending spring seat flange having an uninterrupted outer periphery defined between an upper surface and a bottom surface, said bottom surface adapted to bear against a cylinder head deck, wherein said bottom surface comprises at least one sharp edged protrusion spaced radially inwardly from said outer periphery and extending axially downwardly therefrom, said protrusion also extending radially along said bottom surface, said protrusion being adapted to bite into the surface of the cylinder head deck along a radial area thereof that corresponds to said protrusion.

11. The valve stem seal of claim 10 wherein said sharp edged protrusion on said bottom surface of said spring seat flange is adapted to engage the cylinder head deck and to thereby resist torque forces applied to said spring seat flange by mechanical vibrations.

12. The valve stem seal assembly of claim 10, wherein said entire flange is unbroken between said upper surface and the lowermost axial extent of said protrusion.

* * * * *